US009405248B2

(12) United States Patent
Ueda

(10) Patent No.: US 9,405,248 B2
(45) Date of Patent: Aug. 2, 2016

(54) IMAGE HEATING APPARATUS HAVING LUBRICANT BETWEEN FILM AND NIP FORMING MEMBER

(71) Applicant: CANON KABUSHIKI KAISHA, Tokyo (JP)

(72) Inventor: Shinichi Ueda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/795,262

(22) Filed: Jul. 9, 2015

(65) Prior Publication Data

US 2015/0316875 A1 Nov. 5, 2015

Related U.S. Application Data

(62) Division of application No. 14/100,485, filed on Dec. 9, 2013, now Pat. No. 9,110,413.

(30) Foreign Application Priority Data

Dec. 10, 2012 (JP) ..... 2012-269211

(51) Int. Cl.
*G03G 15/20* (2006.01)

(52) U.S. Cl.
CPC ..... *G03G 15/206* (2013.01); *G03G 15/2053* (2013.01); *G03G 2215/2035* (2013.01)

(58) Field of Classification Search
None
See application file for complete search history.

(56) References Cited

U.S. PATENT DOCUMENTS

2009/0041515 A1 2/2009 Kim
2012/0163882 A1* 6/2012 Kim ..... G03G 15/2025 399/328
2013/0336607 A1* 12/2013 Hirose ..... F16C 33/103 384/397

FOREIGN PATENT DOCUMENTS

JP 2007-072105 A 3/2007
JP 4075329 B2 2/2008
JP 2008-275755 A 11/2008
JP 2009-134074 A 6/2009

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image heating apparatus includes a cylindrical film; a roller contacting the film; a nip forming member contacting an inner surface of the film and cooperating with the roller to form a nip for nipping a sheet carrying an image; an opposing member opposing an inner surface of an end portion of the film along generatrix direction the film. A lubricant is provided between the film and the nip forming member. The film is longer than the roller. At least a part of the curved surface portion is provided in a region outside a contact region of the film and the roller. A portion of the curved surface portion outside the contact region is provided with a groove extending in a rotational moving direction of the film, the groove having a wall effective to remove from the film the lubricant.

14 Claims, 6 Drawing Sheets

(a)

(b)

IMAGE HEATING APPARATUS HAVING LUBRICANT BETWEEN FILM AND NIP FORMING MEMBER

This application is a division of application Ser. No. 14/100,485, filed Dec. 9, 2013.

FIELD OF THE INVENTION AND RELATED ART

The present invention relates to an image heating apparatus which is desirable as a fixing device for an electrophotographic image forming apparatus.

There have known various types of fixing apparatuses (devices) which are used to thermally fix a toner image to a sheet of recording medium. Some of these fixing apparatuses (device) employ a cylindrical sheet of film, a pressure roller, and a nip forming member. The nip forming member is disposed within the hollow of the cylindrical sheet of film, and is disposed in contact with the inward surface of the cylindrical sheet of film. The fixing apparatuses (devices) are structured so that the pressure roller is kept pressed against the nip forming member, with the placement of the cylindrical film between the pressure roller and fixation nip forming member. Thus, a fixation nip is formed between the cylindrical film and pressure roller. Further, the inward surface of the cylindrical film is coated with lubricant such as oil and grease which is for minimizing the amount of torque necessary to circularly move the cylindrical film.

These fixing apparatuses, however, are problematic in that it is possible that while they are in use, the lubricant on the inward surface of the cylindrical film will migrate from the inward surface of the cylindrical film, at the lengthwise ends of the film, and contaminate the fixing device and/or sheet of recording medium.

One of the solutions to the above-described problem is disclosed in Japanese Laid-open Patent Application 2008-275755, and Japanese Patent No. 4075329. According to these patent application and patent, the fixing device is provided with a pair of film guides, which are located at the lengthwise ends of the cylindrical film, one for one. Each film guide is structured so that its portion which protrudes into the hollow of the cylindrical film in such a manner that the cylindrical film slide on this portion of the film guide, which protrudes into the hollow of the cylindrical film. Further, this portion of the film guide is provided with a groove. Thus, as the film is rotated, the lubricant on the inward surface of the film is allowed to move into the groove and then, moves in the inward direction of the film, in terms of the direction parallel to the rotational axis of the film.

However, in order for the lubricant to be move inward of the cylindrical film in terms of the direction parallel to the rotational axis of the film, by the rotational movement of the film, it is necessary that the lubricant is low in viscosity, and also, that the edges of the groove of the film guide is perfectly in contact with the film. If these conditions are not met, the lubricant collects at the opening of the film, migrating eventually out of the inward surface of the film.

Generally speaking, in terms of the direction parallel to the rotational axis of the film, the dimension of the film is greater than that of the pressure roller. Therefore, the lengthwise end portions of the film are not between the pressure roller and nip forming member; they are not pinched by the pressure roller and nip forming member. Thus, the lengthwise end portions of the film are not subjected to the pressure from the pressure roller. In a case where a fixing device is structured so that the lengthwise end portions of the film are not pinched by the pressure roller and nip forming member, it is rather difficult to ensure that the film remains perfectly in contact with the edges of the groove of the film guide, and therefore, the groove is less effective in terms of its function to move the lubricant inward of the film in terms of the direction parallel to the rotational axis of the film. If the lubricant is not efficiently moved inward of the film, it is possible that the lubricant will gradually collect at the opening portions of the film, migrating eventually onto the outward surface of the film, and contaminating a sheet of recording medium.

SUMMARY OF THE INVENTION

The present invention was made in consideration of the above-described problem. Thus, the primary object of the present invention is to provide an image heating apparatus, which does not suffer from the problem that the lubricant on the inward surface of the cylindrical film of a fixing device migrates out of the cylindrical film, at the openings of the film.

According to an aspect of the present invention, there is provided an image heating apparatus comprising a cylindrical film; a rotatable member contacting an outer surface of said film; a nip forming member contacting an inner surface of said film and cooperating with said rotatable member to form a nip for nipping a recording material carrying an image; an inner surface opposing member opposing an inner surface of an end portion of said film in a generatrix direction said film; and wherein a lubricant is provided between said film and said nip forming member, wherein a length of said film is larger than that of said rotatable member in the generatrix direction, at least a part of said curved surface portion is provided in a region outside a contact region in which said film and said rotatable member contacting each other, wherein a portion of said curved surface portion outside the contact region is provided with a groove extending in a rotational moving direction of said film, said groove having a wall effective to remove from said film the lubricant which is deposited on the inner surface of said film and which moves with rotation of said film.

According to another aspect of the present invention, there is provided an image heating apparatus comprising a cylindrical film; a rotatable member contacting an outer surface of said film; a nip forming member contacting an inner surface of said film and cooperating with said rotatable member to form a nip for nipping a recording material carrying an image; and a regulating member including a regulating surface opposing an end surface of said film with respect to a generatrix direction, said regulating surface limits shifting of said film in the generatrix direction, said regulating member including an inner surface opposing member opposing an inner surface of an end portion of said film in a generatrix direction said film; wherein a lubricant is provided between said film and said nip forming member, wherein said curved surface portion is provided with a groove extending in a rotational moving direction of said film, said groove having a wall effective to remove from said film the lubricant which is deposited on the inner surface of said film and which moves with rotation of said film, said regulating surface partly constituting said groove.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, referring to the appended drawings, some of the typical embodiments of the present invention are described in detail. However, the present invention encompasses also various image heating devices (apparatus) which are different from those in the following embodiment, in terms of the dimension, material, and shape of each of the various structural components of a fixing devices, the positional relationship among the structural components, and also, the conditions under which a fixing device is used. That is, the following embodiment of the present invention is not intended to limit the present invention in scope.

Embodiment 1

Figure 1:
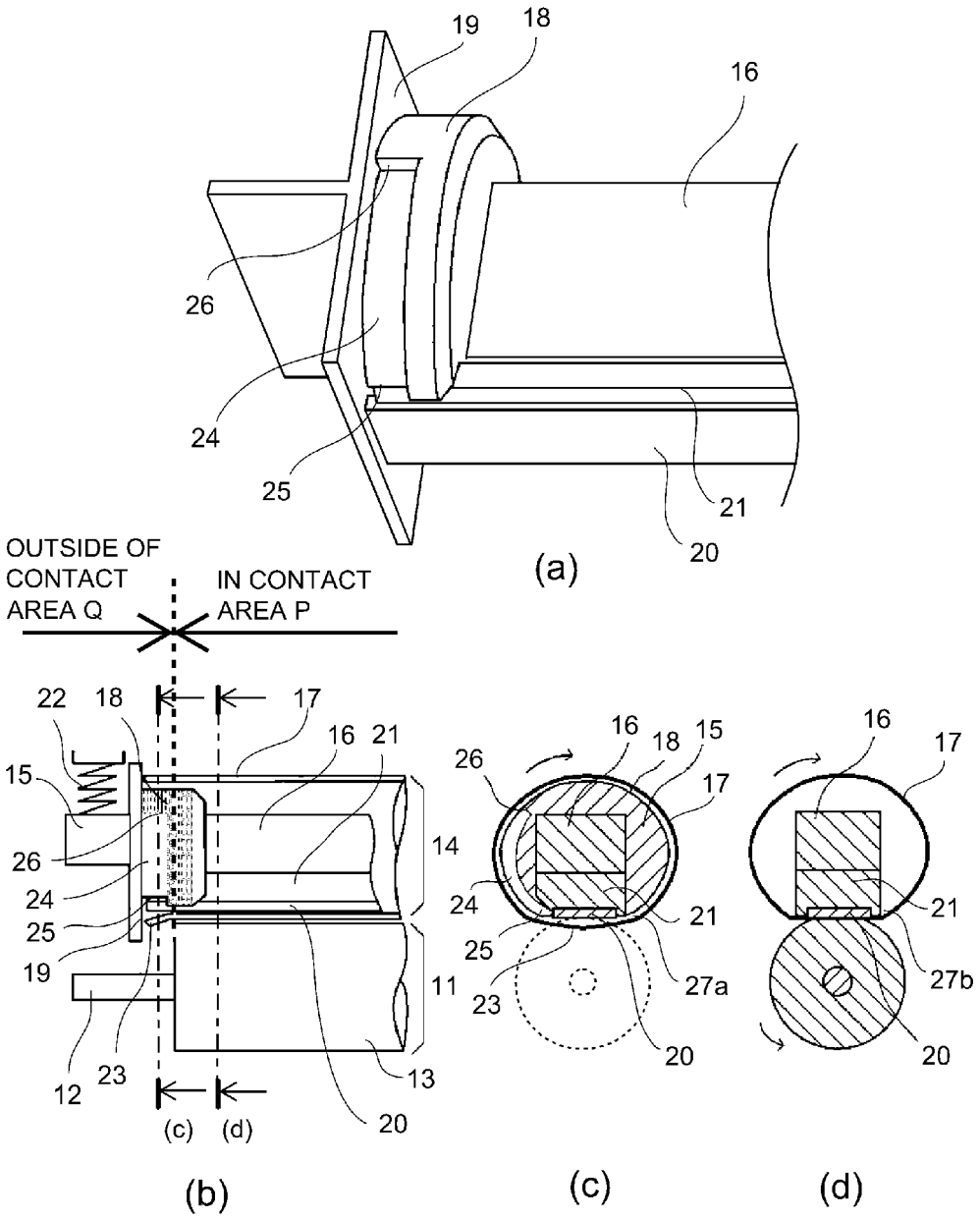
FIG. 1 is a drawing for describing the image heating device (apparatus) in the first embodiment of the present invention.
Figure 2:
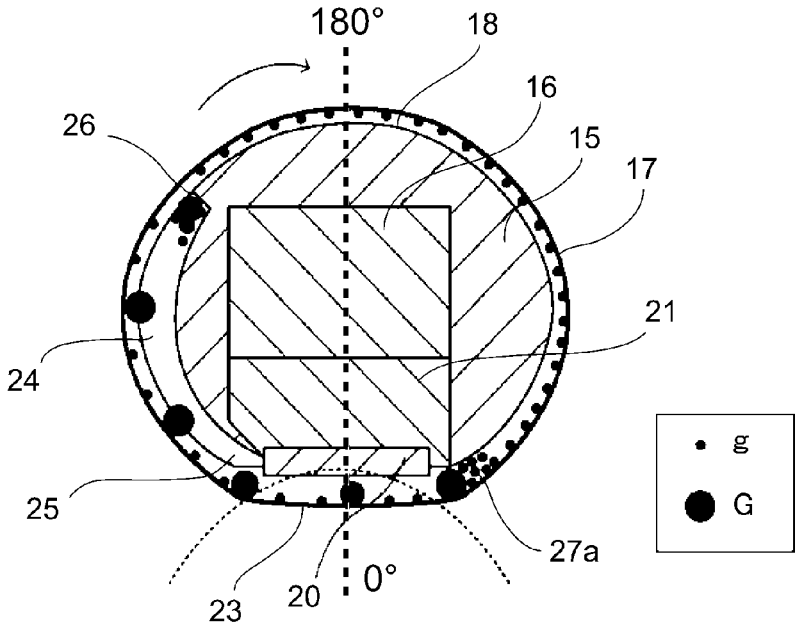
FIG. 2 is a drawing for describing the state of the lubricant in the first embodiment.
Figure 2:
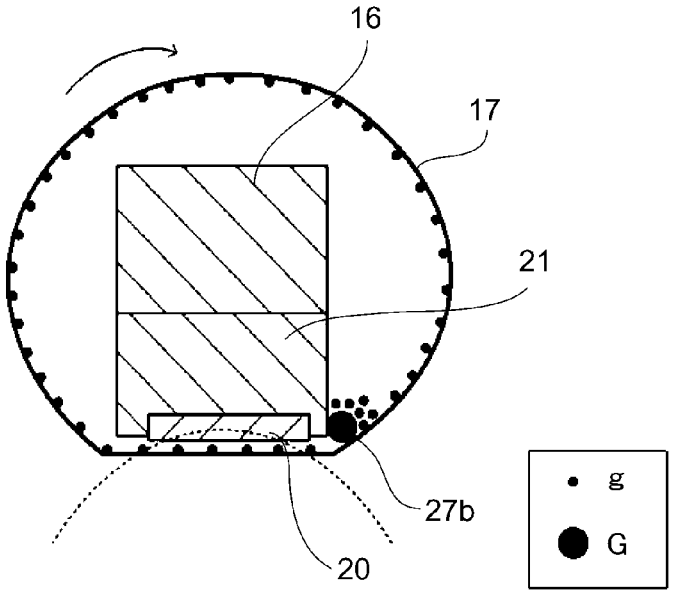

First, referring to FIGS. 1 and 2, the fixing device (image heating device) in the first embodiment of the present invention is described. FIG. 1 is a drawing for describing the fixing device in this embodiment. More specifically, FIG. 1(*a*) is a schematic perspective view of one of the lengthwise end portions of the film supporting unit of the fixing device. FIG. 1(*b*) is a schematic sectional view of one of the lengthwise end portions of the fixing device at a vertical plane parallel to the lengthwise direction of the fixing device. It shows the internal structure of the film supporting unit. FIG. 1(*c*) is a schematic sectional view of the combination of the fixation film and film supporting unit of the fixing device, at a plane (c) in FIG. 1(*b*). FIG. 1(*d*) is a schematic sectional view of the combination of the fixation film, film supporting unit, and pressure roller of the fixing device, at a plane (d) in FIG. 1(*b*). FIG. 2(*a*) is a schematic sectional view of the combination of the fixation film and film supporting member of the fixing device in the first embodiment, at a plane (c) in FIG. 1. It shows the state of the lubricant at the plane (c). FIG. 2(*b*) shows the state of the lubricant at the plane (c) in FIG. 1. Incidentally, the following description of the embodiments of the present invention is limited to only one of the lengthwise end portions of each fixing device. That is, since the other lengthwise end is similar in structure to the end portion which is going to be described, and therefore, is not going to be described.

The application of the present invention is not limited to the fixing devices in the following embodiments of the present invention. That is, it is also applicable to a wide range of image heating apparatuses for heating an object, in addition to those in the following embodiment. For example, it is applicable to an image heating apparatus for heating a sheet of recording medium to change the sheet in surface properties such as gloss (luster), an image heating apparatus for temporarily fixing an unfixed toner image, an image heating apparatus for heating an object, an image heating apparatus for lamination, etc. Further, regarding a sheet of recording medium, the application of the present invention is not limited to an image heating apparatus which uses a sheet of paper. That is, it is also applicable to an image heating apparatus which uses a transfer sheet, a sheet of electrostatically recordable medium, an OHP sheet, a sheet of printing paper, a preformed sheet of paper, etc.

Roughly speaking, the fixing apparatus in this embodiment is made up of a driver roller (rotational member) 11, and a film unit 14. The driver roller 11 is rotated in such a direction that a sheet of recording medium is conveyed in a preset direction in an image forming apparatus, by the driving device (unshown), with which the main assembly of the image forming apparatus is provided. More concretely, the rotational axis of the driver roller 11 extends in the direction perpendicular to the recording medium conveyance direction. The driver roller 11 is made up of a metallic core 12, and an elastic portion 13. The elastic portion 13 is concentric with the core 12. It is formed as an integral part of the driver roller 11, of heat resistant substance such as silicone rubber, fluorinated rubber, or foamed silicon rubber, or the like.

The film unit 14 is disposed so that the driver roller 11 is pressed against the film unit 14. It has a pair of film edge guides 15 formed of heat resistant resin. The pair of film edge guides 15 constitutes the lengthwise portions of the film unit 14, and is connected by a metallic frame 16, which provides the film unit 14 with rigidity. A referential code 17 stands for a cylindrical film, which is open at its lengthwise ends. The cylindrical film 17 (which hereafter will be referred to simply as film 17) is rotatably supported by its lengthwise ends, by the above described pair of film edge guides 15, one for one. It is rotationally moved by the rotation of the driver roller 11 (it rotates in opposite direction from rotational direction of driver roller 11). The rotational axis of the film 17 (direction of generatrix of film 17) is roughly parallel to the rotational axis of the driver roller 11. Further, in terms of the direction parallel to the rotational axis of the film 17, the film 17 is longer than the elastic portion 13 of the driver roller 11. Moreover, the film 17 is positioned relative to the elastic portion 13 in such a manner that its lengthwise end portions extend beyond the lengthwise ends of the elastic portion 13. Each film guide 15 has a film supporting surface 18 (which faces inward surface of film 17), on which the inward surface of the opening portion (lengthwise end portions) of the film 17 slides. It has also a film position regulating surface 19, with which one of the lengthwise ends (lateral edges) of the film 17 makes contact. That is, the film edge guide 15 plays the role of the member of the film unit 14, which opposes the inward surface of the lengthwise end portion of the film 17. In addition, the film edge guide 15 in this embodiment has a film regulating surface, which opposes the corresponding end (edge) of the film 17, in terms of the direction parallel to the generatrix of the film 17, and plays the role of a regulating member for regulating the positional deviation of the film 7 in the direction parallel to the generatrix of the film. As described above, the film edge guide 15 in this embodiment an integral combination of the portion which faces the inward surface of the film 17, and the portion which regulates the film 17 in the positional deviation.

A referential code 20 stands for a ceramic heater for heating the film 17. The heater 20 is a member against which the film 17 is pressed. Thus, its outward surface in terms of the radius direction of the film 17 is in contact with the inward surface of the film 17. It contains a heat generating member, which instantly generates heat, being therefore capable of instantly heating the film 17, as it is supplied with electric power from the main assembly of the image forming apparatus. Further, the fixing device is provided with a frame, and a film guide 21 attached to the frame 16. The heater 20 is supported by the film guide 21, extending from one lengthwise end of the film 17 to the other in terms of the direction parallel to the rotational axis of the film 17. In this embodiment, the heater 20, film guide 21, and driver roller 11, are the nip forming members which form the fixation nip. The film edge guide 15 is at each of the lengthwise ends of the film 17. The heater 20 remains pressed against the driver roller 11, with the presence of the film 17 between the film unit 14 and driver roller 11, by the pressure generated by the resiliency of a pressure generating member 22 which generates such a force that presses the film unit 14 toward the driver roller 11. Thus, a nip (fixation nip), through which a sheet of recording medium is conveyed while remaining pinched between the film 17 and driver roller 11, and also, while being subjected to heat and pressure, is formed and maintained between the outward surface of the film 17 and the peripheral surface of the driver roller 11. The inward surface of the film 17 is coated with heat resistant fluorinated lubricant for minimizing in friction the area of contact between the film 17 and the combination of the heater 20, film guide 21, and film guide 15.

A referential code 23 stands for the radially expanded lengthwise end portion of the film 17. When the film 17 is in its natural state (before it is mounted in fixing device), it is roughly cylindrical. However, as it is mounted in the fixing device, the portion of the film 17, which corresponds in position to the combination of the heater 20, film guide 21, and driver roller 11, is compressed in the fixation nip. Thus, the lengthwise end portions of the film 17, which are outside the fixation nip in terms of the direction parallel to the rotational axis of the film 17, is different in contour from the portion of the film 17, which is inside the fixation nip. Referring to FIG. 1(*d*), the portion of the film 17, which corresponds in position to the nip (area P of contact between film and driver roller), is pressed toward the heater 20 by the driver roller 11; as a given portion of the film 17 is moved into the fixation nip, it is pressed toward the heater 20 by the driver roller 11. In comparison, the portion of the film 17, which is in an area Q, that is, the area on the outward side of the driver roller 11 in terms of the direction parallel to the rotational axis of the driver roller 11, is not under the pressure from the driver roller 11. That is, the only force to which it is subjected is its own resiliency which acts to restore the film 17 in shape, that is, to give the film 17 its intrinsic shape, or the cylindrical shape. Consequently, the lengthwise end portions of the film 17, more specifically, the portions of the film 17, which are outside the fixation nip, partially separates from the heater 20, as shown in FIGS. 1(*b*) and 1(*c*). Hereafter, this portion of the film 17, that is, the portion of the film 17, which is temporarily separated from the film edge guide 15, is referred to as portion 23. Next, referring to FIG. 1(*b*), in terms of the direction parallel to the generatrix of the film 17, the film 17 is longer than the driver roller 11, and the portion of the film 17, which slides on the film edge guide 15, is at least partially in the above described area Q, that is, the area outside the area P of contact.

The film edge guide 15 is provided with a groove 24, the opening of which in terms of the radius direction of the film edge guide 15 coincides with the film supporting surface 18, on which the film 17 slides. The upstream end of the groove 24 in terms of the rotational direction of film 17 (downstream end of area of contact between film 17 and heater 20 in terms of rotational direction of film 17) is provided with an opening 25, as a lubricant entrance, through which the lubricant flows into the groove 24. That is, in terms of the rotational direction of the film 17, the entrance of the groove 24 is on the immediate downstream side of the nip forming member. Further, the groove 24 extends downstream from the opening 25 in terms of the rotational direction of the film 17. It has an end wall (surface) 26, which is the opposite end of the groove 24 from the opening (entrance) 25 in terms of the rotational direction of the film 17. The wall (surface) 26 is perpendicular to the rotational direction of the film 17. Further, in terms of the direction parallel to the rotational axis of the film 17, the groove 24 is on the outward side of the elastic portion 13 of the driver roller 11. That is, the groove 24 is in the area Q, which is on the outward side of the area P of contact between the film 17 and elastic portion 13. In other words, in terms of the rotational direction of the film 17, the position of the groove 24 coincides with the position of the radially expanded portion 23 of the film 17.

Further, in this embodiment, the outward lateral wall (surface) of the groove 24 in terms of the direction parallel to the rotational axis of the film 17, is a part of the film position regulating surface 19 of the film edge guide 15. Therefore, even when the film 17 is in contact with the film position regulating surface 19, the lubricant having been pushed out of the nip and collected in the radially expanded portion 23 of the film 17 can be recovered by the groove 24. By the way, it is not mandatory that the film position regulating surface 19 makes up the outward lateral surface of the groove 24, although it is preferable that the film regulating surface 19 makes up the outward lateral wall (surface) of the groove 24.

Next, referring to FIGS. 2(*a*) and 2(*b*), the lubricant coated on the inward surface of the film 17 is described about its behavior. Letters G and g in FIGS. 2(*a*) and 2(*b*) stand for the thicknesses of the layer of the lubricant on the inward surface of the film 17; G stands for "thick," whereas g stands for "thin".

First, referring to FIG. 2(*b*), which shows the state of the lubricant at the sectional plane of FIG. 1(*d*). As described above, the film 17 remains pressed upon the heater 20 by the pressure applied to the film 17 from the driver roller 11. Therefore, as a given portion of the layer of lubricant on the inward surface of the film 17 is moved into the nip (between heater 20 and film 17) by the rotation of the film 17, it is spread, being thereby made thinner (state g). Thus, as this portion of the layer of lubricant is moved out of the nip, it does not come into contact with any component of the fixing device until it is made by roughly one full rotation of the film 17, to reach a space 27*b*, which is on the immediately upstream side of the nip. Thus, it remains unchanged in thickness until it reaches the space 27*b*. Therefore, the excessive portion of the layer of lubricant is dammed up into the space 27*b*, growing into a lump of lubricant of a substantial size (g→G). The lubricant is fluid. Therefore, as the rotation of the film 17 continues, the lubricant gradually flows toward the area of the film 17 where no lubricant is present, that is, the opening (lengthwise end) of the film 17. Consequently, the portion of the lubricant (in state G) having collected in the space 27*b* gradually moves toward the space 27*a* in FIG. 2(*a*), that is, outward of the film 17 in terms of the direction parallel to the rotational axis of the film 17.

Next, referring to FIG. 2(*a*), the behavior of the lubricant at the lengthwise end of the film 17 is described. FIG. 2(*a*) shows the state of lubricant at the sectional plane (c) in FIG. 1(*b*). As described above, the lubricant continues to flow into the space 27*a* from the inward side of the film 17 in terms of the direction parallel to the rotational axis of the film 17. The amount of the lubricant in the space 27*a* corresponds to "G". As the film 17 rotates, the lubricant in the space 27*a* gradually moves downstream in terms of the rotational direction of the film 17. As described, there is the radially expanded portion 23 of the film 17, on the immediately downstream side of the space 27*a* in terms of the rotational direction of the film 17. Therefore, the layer of lubricant is not spread, being therefore allowed to move between the heater 20 and film 17 while remaining in the state G. Further, as a given portion of the layer of lubricant is moved past the downstream end of the heater 20 in terms of the rotational direction of the film 17, there is the opening (entrance) 25 of the groove 24. Therefore, it can enter the groove 24 while remaining the same in thickness. Eventually, this portion of the layer of lubricant, which is G in thickness, reaches the wall (surface) 26, the downstream side of which is the film supporting surface 18 of the film edge guide 15, on which the film 17 slides. Thus, this portion of the layer of lubricant, which is G in thickness, is partially shaved away by the edge of the wall (surface) 26 of the groove 24, becoming a layer of lubricant which is g in thickness. It is desired that the wall (surface) 26 is within a range of 180° from the center of the nip (center of heater 20) in terms of the rotational direction of the film 17. As for the groove 24, it is positioned within 180° from the center of the nip.

As described above, in this embodiment, the excessive portion of the lubricant coated on the inward surface of the film 17 is efficiently recovered by the wall (surface) 26 of the groove 24, even if the lubricant is high in consistency. That is, this embodiment can prevent the problem that the lubricant (which is G in thickness) on the inward surface of the film 17 oozes out of the hollow of the film 17 from the lengthwise ends of the film 17, and migrates onto the outward surface of the film 17. Further, this embodiment makes it unnecessary to increase the contact pressure between the film 17 and film edge guide 15, in order to scrape away the excessive amount of the lubricant. Thus, this embodiment does not reduce the film 17 in durability.

Although not illustrated, the upstream end of the groove 24 may be provided with an extension, as a lubricant reservoir, which extends inward of the film 17 from the upstream end of the groove 24 in terms of the direction parallel to the rotational axis of the film 17, and opens on the inward side of the film supporting surface 18. This setup can prevent the lubricant from collecting by an excessive amount at the upstream end of the groove 24. Therefore, this setup can utilize the lubricant on the inward surface of the film 17 as efficiently as possible.

Embodiment 2

Figure 3:
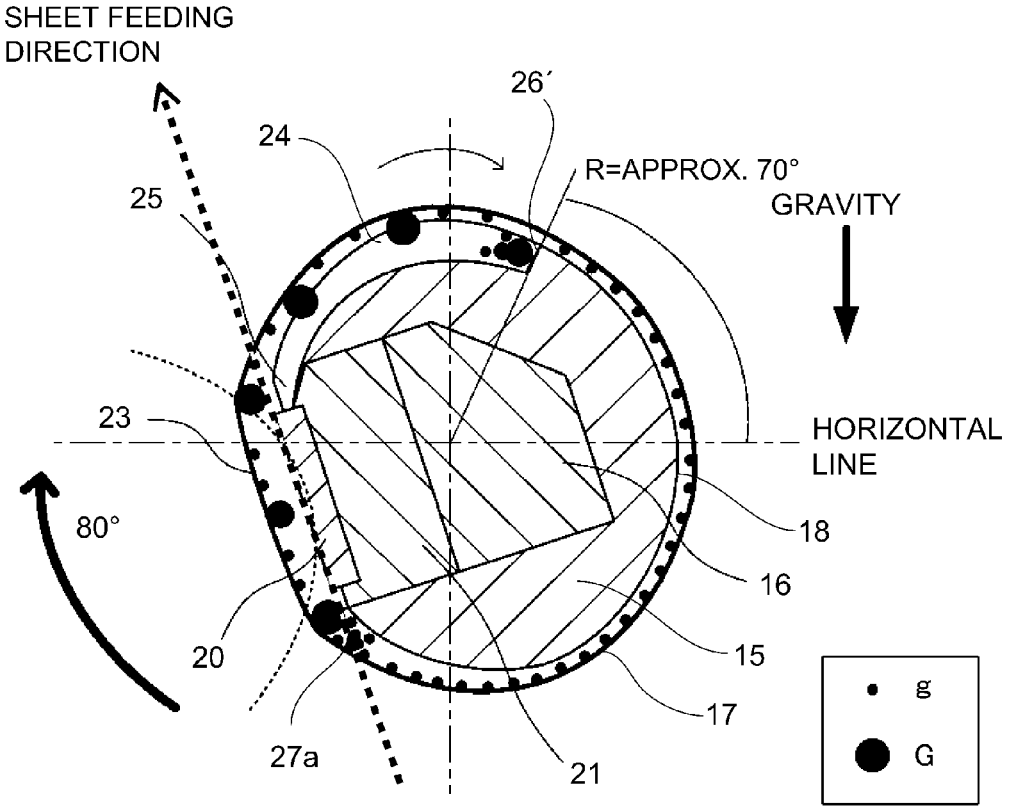
FIG. 3 is a drawing for describing the state of the lubricant in the second embodiment.

Next, referring to FIG. 3, the fixing device in the second embodiment of the present invention is described. FIG. 3 is a schematic sectional view of the combination of the film 17 and film supporting unit. It is a drawing for describing the state of the lubricant on the inward surface of the film 17 of the fixing device in this embodiment. The components, parts, etc., of the fixing device in this embodiment, which are similar in structure to the counterparts in the first embodiment are given the same referential codes as the counterpart, and are not going to be described here. The features of the fixing device in this embodiment, which are not specifically described, are the same as those of the fixing device in the first embodiment.

FIG. 3 is a schematic sectional view of the combination of the film 17 and film supporting unit of the image heating apparatus in this embodiment, the position of which is 80 degrees downstream from the position of the counterpart in the first embodiment in terms of the rotational direction of the film 17. Because the combination in this embodiment is tilted by 80 degrees relative to the counterpart in the first embodiment, the angle R of the wall (surface) 26' of the groove 24 is roughly 70° relative to the horizontal line which coincides with the rotational axis of the film 17. Therefore, the small space which the wall (surface) 26' of the groove 24 forms with the adjacent walls of the groove 24, functions like a small pouch into which the lubricant is collected by gravity. Further, the groove 24 is provided with an area which is positioned higher than the downward lengthwise end (wall surface) of the groove 24 in terms of the vertical direction. Therefore, it does not occur that as the lubricant is scraped away by the edge of the wall (surface) 26', it is made by gravity to flow upstream in the groove 24 in terms of the rotational direction of the film 17. As described above, in the case of the fixing device in this embodiment, in order to ensure that as the layer of lubricant on the inward surface of the film 17 is partially scraped away by the edge of the wall (surface) 26' of the groove 24, the portion of the lubricant removed by the wall (surface) 26' is made by gravity to remain in the adjacencies of the wall (surface) 26', the fixing device is structured so that the direction in which a sheet of recording medium is conveyed through the nip is tilted relative to the horizontal direction.

As described above, not only can this embodiment provide the same effects as the first embodiment, but also, can make it possible to keep the recovered lubricant in the adjacencies of the wall (surface) 26'. Regarding the position of the wall (surface) 26', the longer the groove 24, the greater the groove 24 in the amount by which it can store the recovered lubricant. However, the closer the position of the wall (surface) 26' to 0° (horizontal), the greater the amount by which the recovered lubricant leaks in the rotational direction of the film 17 is likely to be. Therefore, it is desired that the angle R of the wall (surface) 26' is within a range of 0°-90° (0°<90°).

Embodiment 3

Figure 4:
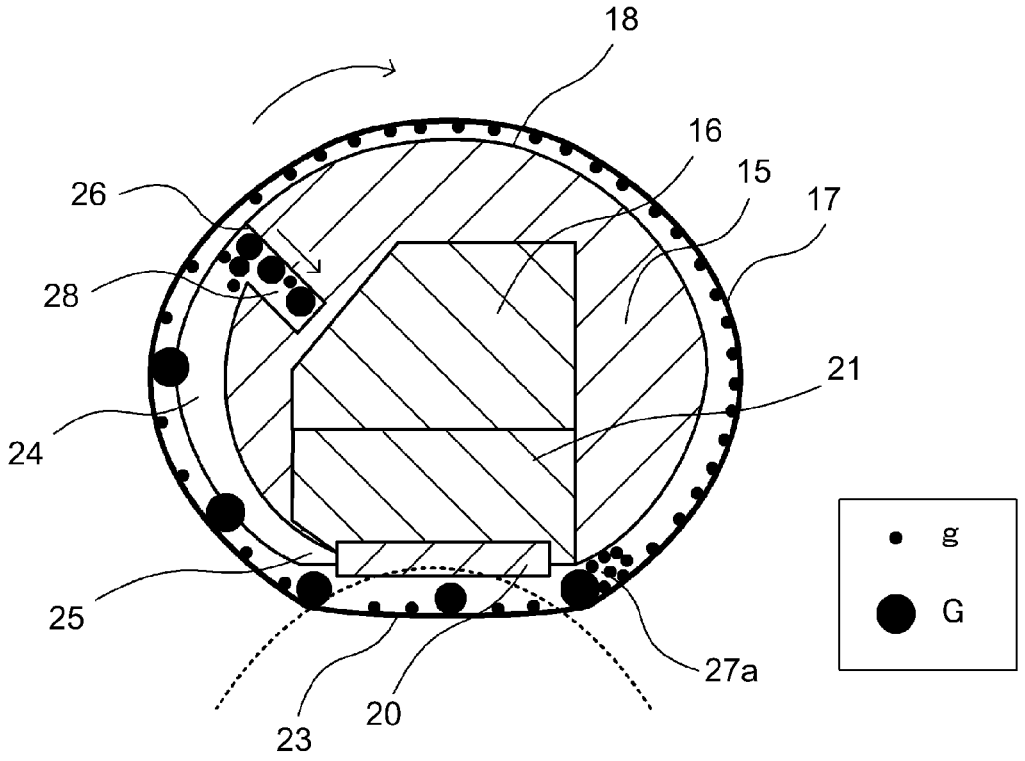
FIG. 4 is a drawing for describing the state of the lubricant in the third embodiment.

Next, referring to FIG. 4, the fixing device in the third embodiment is described. FIG. 4 is a schematic sectional view of the combination of the fixation film 17 and film supporting unit in this embodiment. It shows the state of the lubricant in this embodiment. The structural components of the fixing device in this embodiment, which are the similar in structure to those of the fixing device in the first embodiment are given the same referential codes as the counterparts in the first embodiment, and are not described here. That is, the structural components of the fixing device in this embodiment, and the features thereof, which are not described here, are the same as those of the fixing device in the first embodiment, unless specifically noted.

Referring to FIG. 4, the fixing device in this embodiment is roughly the same in structure as that in the first embodiment, except that the downstream end portion of the groove 24 in this embodiment is provided with an extension hole 28. That is, the downstream end portion of the groove 24 in this embodiment is deeper than the rest. Thus, the groove 24 in this embodiment can store a greater amount of lubricant than the groove 24 in the first embodiment. That is, this embodiment can increase the amount by which the lubricant can be stored in the groove 24. Further, as the layer of lubricant is scrapped by the wall (surface) 26, the removed lubricant enters the extension hole 28, making it unlikely for the removed lubricant to collect in the rest of the groove 24. Therefore, the removed lubricant is unlikely to adhere to the film 17 again.

The shape and depth of the extension hole 28 may be changed according to the amount by which the lubricant is coated on the inward surface of the film 17. Further, in consideration of the direction of gravity, the fixing device may be positioned at such an angle that can increase the fixing device in the efficiency with which the removed lubricant is recovered.

As described above, not only can this embodiment provide the same effects as those which the first embodiment can provide, but also, can increase the fixing device in the amount by which the lubricant is recovered to prevent the recovered lubricant from adhering to the film 17 again.

Embodiment 4

Figure 5:
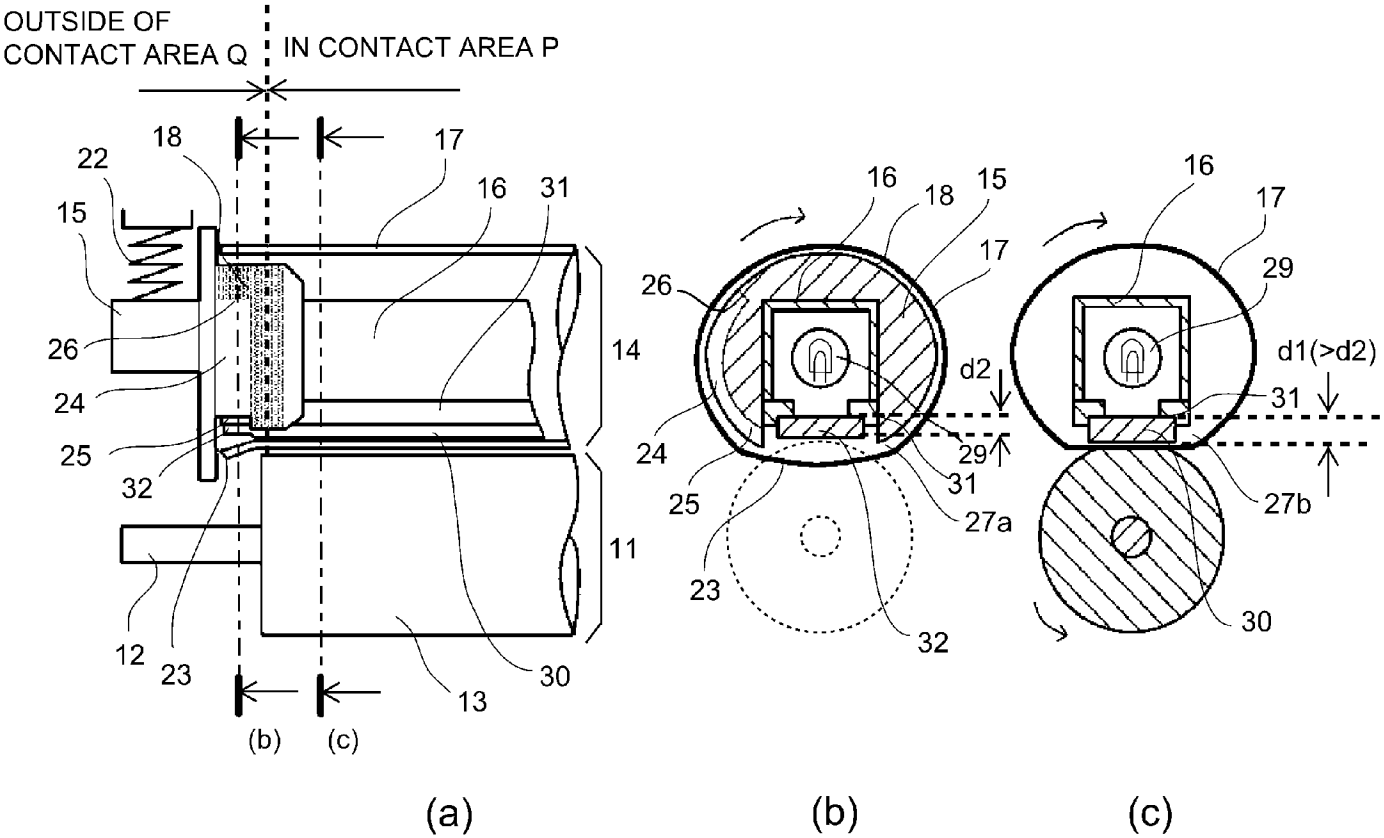
FIG. 5 is a drawing for describing the image heating device (apparatus) in the fourth embodiment.

Next, referring to FIG. 5, the fixing device in the fourth embodiment of the present invention is described. FIG. 5 is a schematic sectional view of the fixing device in the fifth embodiment. More specifically, FIG. 5(*a*) is a schematic sectional view of one of the lengthwise end portions of the fixing device, at a vertical plane parallel to the lengthwise direction of the fixing device, and shows the structure of the lengthwise end portion. FIG. 5(*b*) is a schematic sectional view of the fixing device, at a plane (b) in FIG. 5(*a*). FIG. 5(*c*) is a schematic sectional view of the fixing device, at a plane (c) in FIG. 5(*a*). The components of the fixing device in this embodiment, which are the same in structure and/or feature as the counterparts in the first embodiment are given the same referential codes as those given to the counterparts, and are not going to be described here. That is, the items of the fixing device in this embodiment, which are not described here, are the same in features as those in the first embodiment, unless specifically noted.

A referential code 29 stands for a halogen heater. There is disposed a heat conducting member 30 between the halogen heater 29 and driver roller 11. The heat conducting member 30 is formed of a substance (which in this embodiment is a piece of metallic plate) which is excellent in thermal conductivity. The heat conducting member 30 is heated by the heat from the halogen heater 29. In this embodiment, it is the heat conductive member 30 that is one of the nip forming members. The heat conducting member 30 is attached to the frame 16, with the placement of a holder 31 between itself and the frame 16. Further, the heat conducting member 30 is in contact with the inward surface of the film 17, and conducts the heat from the heater 29 to the film 17, and also, keeps the film 17 pressed upon the film 17. Since the material of the heat conducting member 30 is a metallic substance, the heat conducting member 30 can be formed in any shape suitable to optionally set the contact pressure between the driver roller 11 and film 17 in terms of the rotational direction of the driver roller 11, and/or the direction parallel to the rotational axis of the driver roller 11. Like the film 17 in the first embodiment, the inward surface of the film 17 in this embodiment is also coated with fluorinated lubricant. Therefore, the lubricant is forced out into the space 27*a* by the same mechanism as the one described in the description of the first embodiment.

A referential code 32 stands for one of the end portions of the heat conducting member 30, in terms of the rotational direction of the film 17, which is thinner than the rest of the heat conducting member 30. In terms of the rotational direction of the film 17, the position of the thin portion 32 of the heat conducting member 30 coincides with that of the aforementioned radially expanded portion 23 of the film 17. That is, it is in the area Q, which is on the outward side of the area P of contact between the film 17 and driver roller 11. The thickness d2 of the thin portion 32 is less than the thickness d1 of the portion of the heat conducting member 30, which forms the fixation nip. Therefore, the thin portion 32 is unlikely to contact the inward surface of the film 17. That is, the portion of the heat conducting member 30 (nip forming member), which is in the area Q, is recessed relative to the peripheral surface of the driver roller 11. The presence of this thin portion 32 increases the space formed by the film 17 and heat conducting member 30, on upstream side of the upstream end portion of the heat conducting member 30. Therefore, as the lubricant is squeezed out into the space 27*a*, it can flow into the groove 24 without coming into contact with the heat conducting member 30. Therefore, even if the amount by which the lubricant is squeezed out into the space 27*a* increases, it is possible for the lubricant to be guided into the groove 24 without collecting in the adjacencies of the heat conducting member 30.

Embodiment 5

Figure 6:
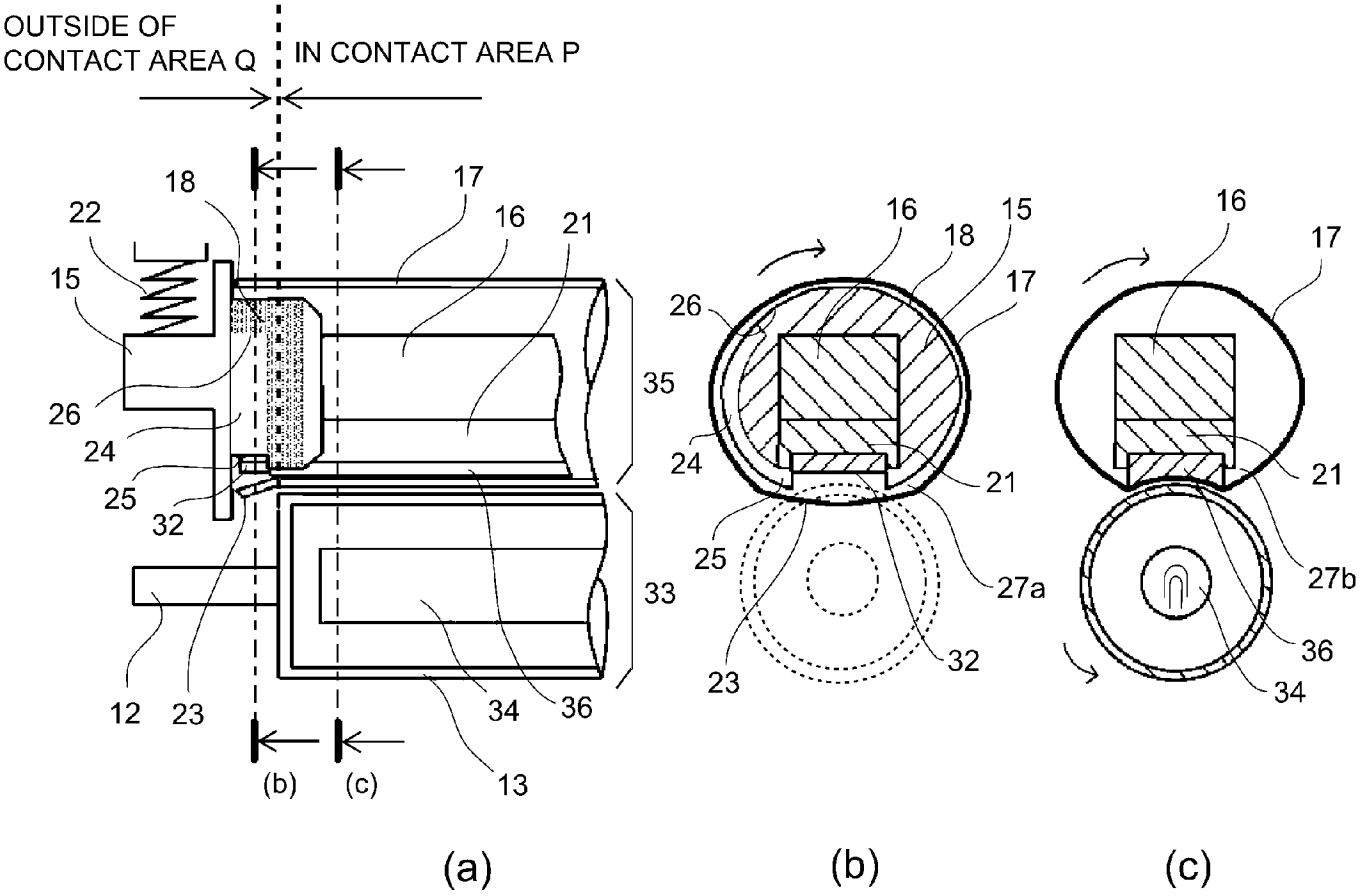
FIG. 6 is a drawing for describing the image heating device (apparatus) in the fifth embodiment.

Next, referring to FIG. 6, the fixing device in the fifth embodiment of the present invention is described. FIG. 6 is a schematic sectional view of the fixing device in this embodiment. More specifically, FIG. 6(*a*) is a schematic sectional view of one of the lengthwise end portions of the fixing device, at a vertical plane parallel to the lengthwise direction of the device. FIG. 6(*b*) is a schematic sectional view of the fixing device at a plane (b) in FIG. 6(*a*). FIG. 6 (*c*) is a schematic sectional view of the fixing device at a plane (c) in FIG. 6(*a*). In FIG. 6, the components, parts thereof, etc., of the fixing device, which are similar in structure and/or feature to the counterparts in the first embodiment are given the same referential codes as those given to the counterparts, and are not going to be described here. Further, the items of the fixing device in this embodiment, which are not described, are the same as those of the fixing device in the first embodiment, unless specifically noted.

A referential code 33 stands for a heat roller, in which a halogen heater 34 as a heat generating member is disposed. A referential code 35 stands for a film pressing unit, which is disposed so that it opposes the heat roller 33 and is pressed against the heat roller 33. The film pressing unit 35 is provided with a pair of film edge guides 15, which make up the lengthwise end portions of the unit 35. The pair of film edge guides 15 is connected by a frame 16, which provides the film pressing unit 35 with rigidity. A referential code 17 stands for a cylindrical film, which is rotatably supported by its lengthwise portions, by the pair of film edge guides 15.

A referential code 36 stands for a nip guide (nip forming member), which is supported, in contact with the film 17, by the film guide 21 attached to the frame 16, across its entire range in terms of the direction parallel to the rotational axis of the film 17. The nip guide 36 is kept pressed against the heat roller 32 by the pressure generated by the resiliency of a pair of pressing members 22 for pressing the film pressing unit 35. The inward surface of the film 17 is coated with heat resistant fluorinated lubricant for reducing the friction in the interface between the film 17 and the combination of the nip guide 36, film guide 21, film guide 35.

The material for the nip guide 36 is heat resistant resin, or metal. Therefore, the nip guide 36 can be formed in any shape. In this embodiment, the nip guide 36 is formed so that its portion opposing the heat roller 32 conforms in curvature to the heat roller 32 as shown in FIG. 6(*c*). As in the case of the fourth embodiment, the end portion 32 of the nip guide 36 is made thinner than the rest. Further, the fixing device is structured so that in terms of the direction parallel to the rotational axis of the film 17, this thin end portion 32 roughly coincides in position with the radially expanded portion 23 of the film 17, as in the fourth embodiment. Therefore, this embodiment can provide the same effects as the fourth embodiment.

Not only can the embodiments described above be individually utilized, but also, in combination.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 269211/2012 filed Dec. 10, 2012 which is hereby incorporated by reference.

What is claimed is:

1. An image heating apparatus comprising:

a cylindrical film;

a rotatable member contacting an outer surface of said film;

a nip forming member contacting an inner surface of said film and cooperating with said rotatable member to form a nip for nipping a recording material carrying an image; and an inner surface opposing member opposing an inner surface of an end portion of said film in a generatrix direction of said film, wherein said inner surface opposing member includes a film supporting surface, wherein the inner surface of the end portion of said film slides on the film supporting surface, wherein the film supporting surface is provided with a groove recessed relative to the film supporting surface and extending in a rotational moving direction of said film, wherein a lubricant is provided between said film and said nip forming member, wherein said groove has an entrance which is provided immediately after a downstream side end portion of said nip forming member with respect to the rotational moving direction, wherein said groove has a wall, wherein said wall has a surface in a plane intersecting the rotational axis of said film at the position downstream of the entrance of said groove with respect to the rotational moving direction, wherein said wall is configured to remove from said film the lubricant which is deposited on the inner surface of said film and which moves with rotation of said film, wherein said wall is disposed at the same position as said groove along the generatrix direction of said film, and wherein said wall is provided in an area between a center portion of said nip and 180° away therefrom with respect to the rotational moving direction.

2. An apparatus according to claim 1, wherein said wall is perpendicular to the rotational moving direction.

3. An apparatus according to claim 1, further comprising a regulating member including a regulating surface opposing an end surface of said film with respect to the generatrix direction, wherein said regulating surface limits shifting of said film in the generatrix direction.

4. An apparatus according to claim 3, wherein said inner surface opposing member and said regulating member comprise an integral part.

5. An apparatus according to claim 4, wherein said regulating surface partly constitutes said groove.

6. An apparatus according to claim 1, wherein an end portion of said groove with respect to the rotational moving direction has a depth larger than another portion of said groove.

7. An apparatus according to claim 1, further comprising a heater inside said film.

8. An apparatus according to claim 7, wherein said nip forming member is provided with said heater.

9. An image heating apparatus comprising:

a cylindrical film;

a rotatable member contacting an outer surface of said film;

a nip forming member contacting an inner surface of said film and cooperating with said rotatable member to form a nip for nipping a recording material carrying an image; and a regulating member including a regulating surface opposing an end surface of said film with respect to a generatrix direction of said film, wherein said regulating surface limits shifting of said film in the generatrix direction, wherein said regulating member includes an inner surface opposing portion opposing an inner surface of an end portion of said film in a generatrix direction, wherein said inner surface opposing portion includes a film supporting surface on which the inner surface of the end portion of said film slides, wherein the film supporting surface is provided with a groove recessed relative to the film supporting surface and extending in a rotational moving direction of said film, wherein a lubricant is provided between said film and said nip forming member, wherein said groove has an entrance which is provided immediately after a downstream side end portion of said nip forming member with respect to the rotational moving direction, wherein a wall is provided in an area between a center portion of said nip and 180° away therefrom with respect to the rotational moving direction, wherein said wall is configured to remove from said film the lubricant which is deposited on the inner surface of said film and which moves with rotation of said film, and wherein said wall is disposed at the same position as said groove along the generatrix direction of said film.

10. An apparatus according to claim 9, wherein said wall is perpendicular to the rotational moving direction.

11. An apparatus according to claim 9, wherein said regulating member is provided at an end portion of said nip forming member with respect to the generatrix direction.

12. An apparatus according to claim 9, wherein an end portion of said groove with respect to the rotational moving direction has a depth larger than another portion of said groove.

13. An apparatus according to claim 9, further comprising a heater inside said film.

14. An apparatus according to claim 13, wherein said nip forming member is provided with said heater.

* * * * *